US010035037B2

(12) United States Patent
Towley

(10) Patent No.: US 10,035,037 B2
(45) Date of Patent: Jul. 31, 2018

(54) SELECTORIZED DUMBBELL HAVING KETTLEBELL STYLE HANDLE

(71) Applicant: Mattson K. Towley, Owatonna, MN (US)

(72) Inventor: Mattson K. Towley, Owatonna, MN (US)

(73) Assignee: PowerBlock Holdings, Inc., Owatonna, MN (US)

( * ) Notice: Subject to any disclaimer, the term of this patent is extended or adjusted under 35 U.S.C. 154(b) by 0 days.

(21) Appl. No.: 15/040,503

(22) Filed: Feb. 10, 2016

(65) Prior Publication Data

US 2017/0225025 A1 Aug. 10, 2017

(51) Int. Cl.
*A63B 21/06* (2006.01)
*A63B 21/075* (2006.01)
*A63B 21/072* (2006.01)

(52) U.S. Cl.
CPC ..... *A63B 21/075* (2013.01); *A63B 21/072* (2013.01)

(58) Field of Classification Search
CPC . A63B 21/06; A63B 21/0601; A63B 21/0605; A63B 21/072–21/075; A63B 21/4033; A63B 21/4035; A63B 21/00065
See application file for complete search history.

(56) References Cited

U.S. PATENT DOCUMENTS 4,482,151 A * 11/1984 Zwilling ..... A63B 21/0605 482/106
5,072,933 A * 12/1991 Diodati ..... A63B 21/072 482/93
5,102,124 A * 4/1992 Diodati ..... A63B 21/0605 482/106
7,491,157 B1 2/2009 Lin
7,563,208 B1 7/2009 Chen
7,981,013 B2 7/2011 Krull
8,002,678 B1 * 8/2011 Krull ..... A63B 21/0728 482/108
8,012,069 B2 * 9/2011 Towley, III ..... A63B 21/0728 482/107
8,021,282 B2 9/2011 Polevoy et al.
2005/0003931 A1 * 1/2005 Mills ..... A63B 21/0601 482/5
2011/0306475 A1 12/2011 Caswell et al.
2013/0040789 A1 2/2013 Kessler
2014/0194258 A1 * 7/2014 Shorter ..... A63B 21/075 482/93
2015/0105224 A1 * 4/2015 Odneal ..... A63B 21/0726 482/107
2015/0196792 A1 * 7/2015 Towley ..... A63B 21/075 482/93

* cited by examiner

*Primary Examiner* — Gregory Winter
(74) *Attorney, Agent, or Firm* — James W. Miller

(57) ABSTRACT

A selectorized dumbbell incorporates a handle assembly that includes a generally triangularly shaped handle housing having an upwardly extending loop style handle in the manner of a kettlebell handle. The handle housing has angled side walls that provide surfaces on which the user's forearm can rest when doing certain exercises. The handle housing is hollow inside. Various add-on weights are vertically stacked on top of another inside the handle housing. The weights are nested together to prevent sliding relative to one another by tongue and groove and pin and hole interconnections. A repositionable connecting pin can be placed into different positions on the handle housing to selectively couple a desired number of the add-on weights to the handle housing.

9 Claims, 4 Drawing Sheets

SELECTORIZED DUMBBELL HAVING KETTLEBELL STYLE HANDLE

TECHNICAL FIELD

This invention relates to hand weights, known as dumbbells, which are used for exercise and/or weight training purposes. More particularly, this invention relates to a selectorized dumbbell that permits the user to selectively attach or couple different numbers of weights to the dumbbell handle from among a set or series of nested weights to vary the exercise mass of the dumbbell.

BACKGROUND OF THE INVENTION

A selectorized dumbbell having an upwardly extending, loop style handle in the style of a kettlebell is disclosed in a published patent application US-2015-0196792-A1. In this dumbbell, a plurality of add-on weights of progressively decreasing size, similar to nesting Russian dolls known as Matroyshka dolls, nest inside a handle housing. The weight of the dumbbell may be easily adjusted by repositioning a movable connecting pin to change how many of the add-on weights will be coupled to the handle housing when the handle housing is lifted and used. Thus, a single selectorized dumbbell of this type is able to replace a plurality of individual kettlebells each of which has a different weight.

While purchasing a single selectorized dumbbell of this type is more cost effective than purchasing a set of individual kettlebells of different weights, the nesting doll approach used for the add-on weights does not effectively use as much of the interior space of the handle housing as might be desirable. Thus, the empty space that remains inside the handle housing even when all the add-on weights are nested inside unnecessarily limits the maximum weight provided by the selectorized dumbbell. In addition, the add-on weights have a tendency to rattle or make some noise in this design due to the tolerance requirements needed to allow them to fully nest inside of one another. Accordingly, it would be a further advance in the art to overcome these problems in a selectorized dumbbell of this type while retaining the easy adjustability of the exercise weight otherwise provided by the dumbbell.

SUMMARY OF THE INVENTION

One aspect of this invention relates to a selectorized dumbbell which comprises a handle assembly. The handle assembly comprises a handle housing having an upwardly extending loop style handle in the manner of a kettlebell handle. The handle housing has an open bottom through which an interior cavity of the handle housing may be accessed. A plurality of weights are vertically stacked on top of one another and when so stacked are received within the cavity of the handle housing. The plurality of weights when so stacked form a plurality of different weight pairs with each weight pair comprising one weight and another weight that is immediately below the one weight and is in direct abutting contact with the one weight at a junction therebetween. The plurality of weight pairs are nested together by tongue and groove interconnections at the junctions therebetween to resist dislodgement of the weights in the weight pairs in a direction that is perpendicular to the tongue and groove interconnections. A selectively repositionable connecting member is provided that can be placed into different positions to selectively couple a desired number of the weights to the handle housing.

Another aspect of this invention relates to a selectorized dumbbell which comprises a handle assembly. The handle assembly comprises a handle housing having an upwardly extending loop style handle in the manner of a kettlebell handle. The handle housing has an open bottom through which an interior cavity of the handle housing may be accessed. The cavity has a predetermined volume. A plurality of weights are vertically stacked on top of one another and when so stacked are received within the cavity of the handle housing. The plurality of vertically stacked weights when received in the handle housing substantially entirely fill the volume of the cavity of the handle housing. A selectively repositionable connecting member is provided that can be placed into different positions to selectively couple a desired number of the weights to the handle housing.

Yet another aspect of this invention comprises a selectorized dumbbell having a handle assembly. The handle assembly comprises a handle housing having an upwardly extending loop style handle in the manner of a kettlebell handle. The handle housing has an elongated top wall, a pair of angled side walls that project downwardly from opposite lateral side edges of the top wall with the side walls diverging outwardly away from one another as the side walls project downwardly to form a generally triangular cross-sectional shape, and vertical end walls that project downwardly from opposite ends of the top wall with the end walls having a height that is substantially the same as the height of the side walls and having a triangular shape that substantially matches the generally triangular cross-sectional shape such that the top wall, side walls, and end walls form an open, generally triangular, interior cavity therebetween. The handle housing further has on open bottom underlying the cavity to provide access to the cavity. A plurality of weights are vertically stacked on top of one another and when so stacked are received within the cavity of the handle housing. Each weight has a shape that occupies and substantially fills in a different vertical section of the cavity. A selectively repositionable connecting member is provided that can be placed into different positions to selectively couple a desired number of the weights to the handle housing.

BRIEF DESCRIPTION OF THE DRAWINGS

This invention will be described more fully in the following Detailed Description, when taken in conjunction with the following drawings, in which like reference numerals refer to like elements throughout.

DETAILED DESCRIPTION

Figure 1:
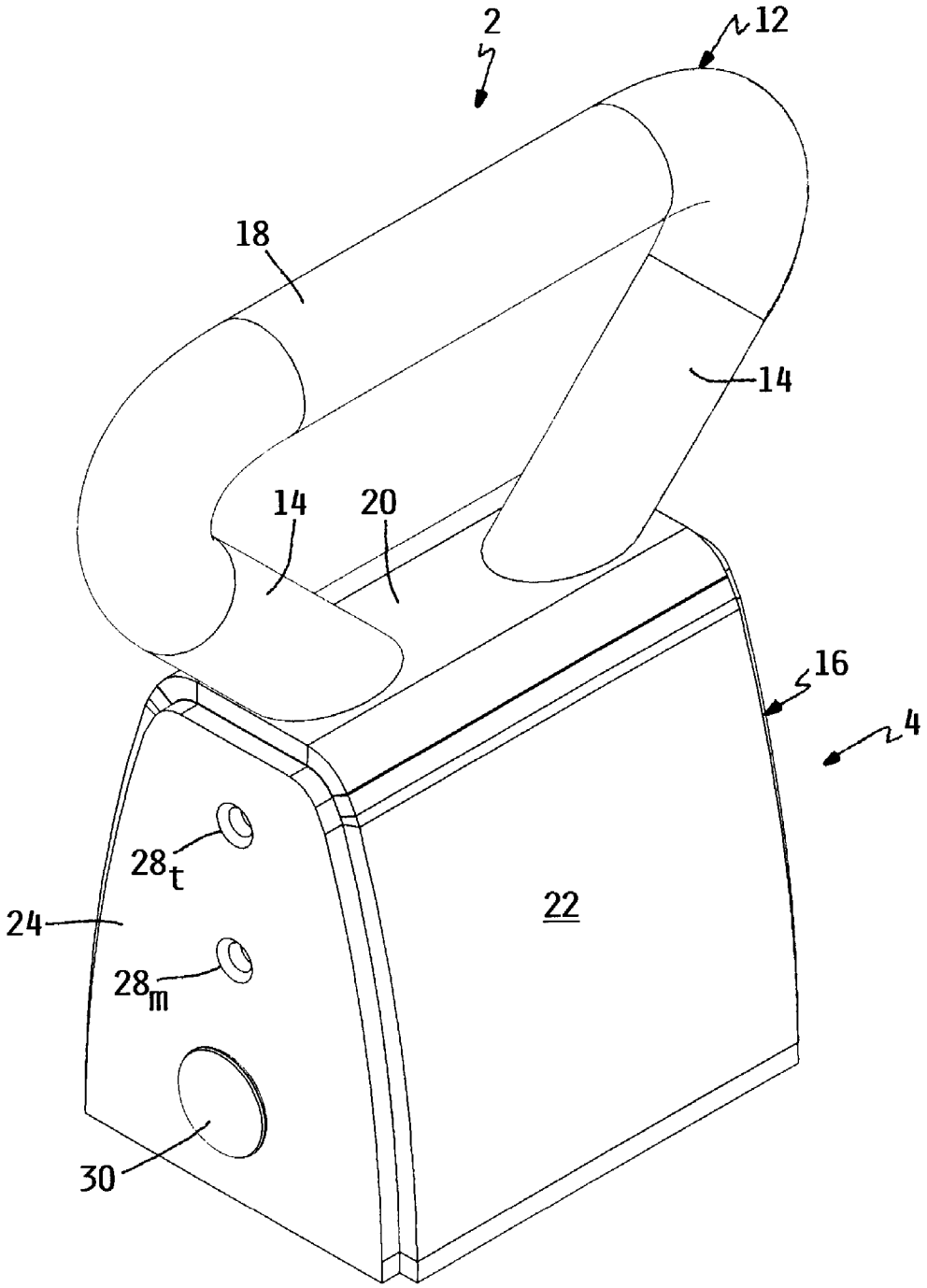
FIG. 1 is a perspective view of one embodiment of a selectorized dumbbell according to this invention.
Figure 2:
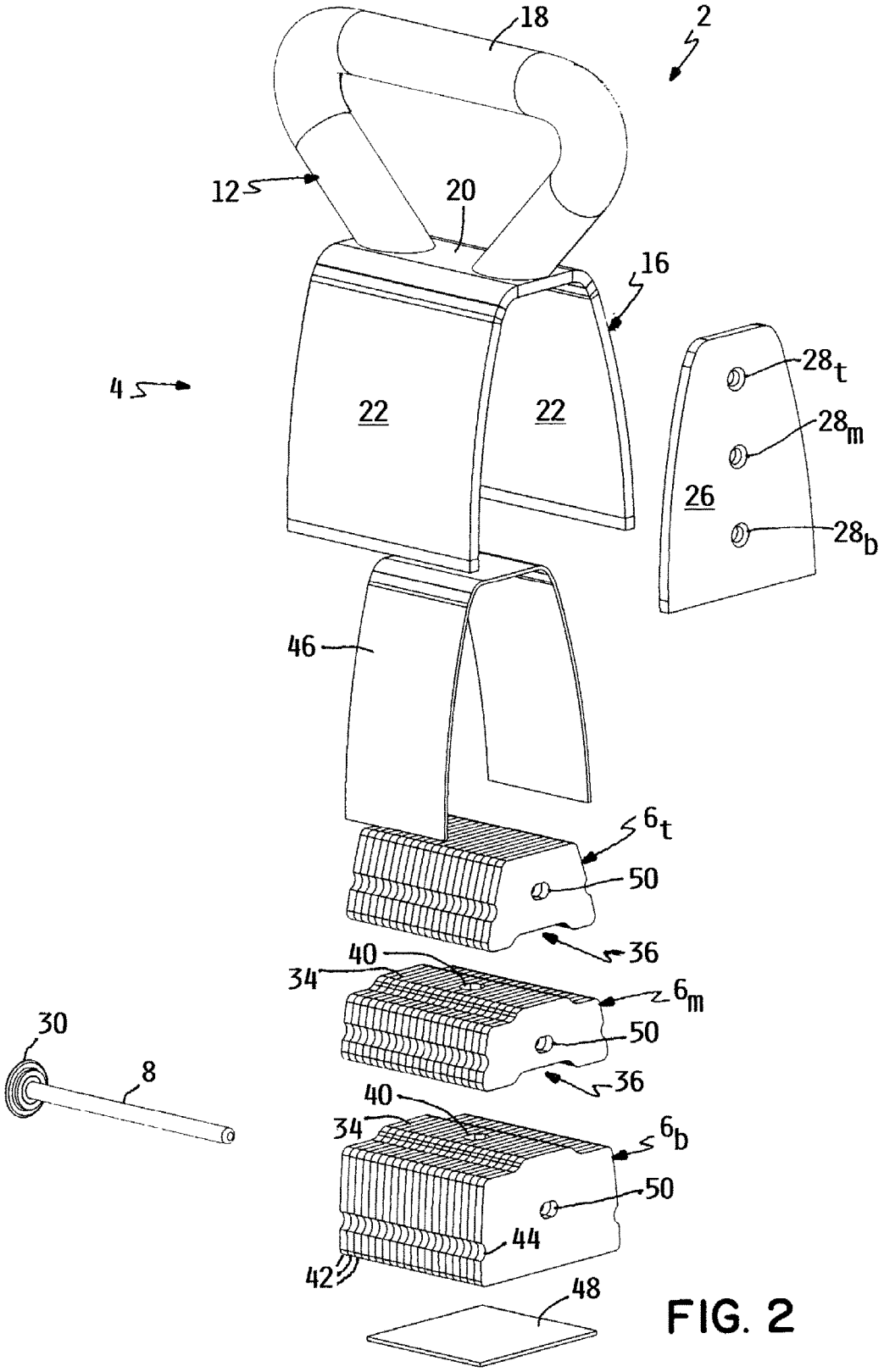
FIG. 2 is a perspective view from a different angle of the dumbbell of FIG. 1, particularly illustrating the dumbbell in an exploded form to show the various components thereof.

Referring first to FIGS. 1 and 2, one embodiment of a selectorized dumbbell according to this invention is shown generally as 2. In general terms, dumbbell 2 comprises a handle assembly 4, a plurality of add-on weights 6 that may be selectively attached or coupled to handle assembly 4 in a desired number to vary the total exercise mass provided by dumbbell 2, and a weight selection mechanism that includes a movable connecting pin 8 which is placed into different positions by the user to select how many weights 6 are used in conjunction with handle assembly 4 at any given time.

Handle assembly 4 includes an upwardly projecting, substantially U-shaped loop handle 12. Handle 12 has a pair of spaced upwardly extending legs 14 whose lower ends are rigidly affixed in any suitable manner to the top of a handle housing 16. The upper ends of legs 14 carry an elongated hand grip 18 therebetween with hand grip 18 being positioned above the top of handle housing 16 by legs 14. Thus, handle 12 is in the style of a kettlebell handle since hand grip 18 is located above handle housing 16 and above the various weights 6 that may be coupled to handle assembly 4. Hand grip 18 is long enough to allow a user to grip and hold hand grip 18 with one hand to be able to use the apparatus of this invention as a dumbbell.

Handle housing 16 forms an exterior enclosure which substantially houses or encloses any or all of weights 6 that are capable of being coupled to handle assembly 4. The overall size of the exterior enclosure provided by handle housing 16 does not change whether only some or all of weights 6 are coupled to handle assembly 4. Thus, dumbbell 2 in use has a substantially uniform, constant size and varies only in how heavy the exercise mass is when the user picks it up. This is an advantage since the relationships of the user's hand and forearm to hand grip 18 and to handle housing 16 remain the same and are unaffected by changes in the exercise mass being provided by dumbbell 2. Thus, if the user's hand and forearm are comfortable for one exercise mass, they will remain comfortable for different exercise masses as the support points for the user's hand on hand grip 18 and for the user's forearm on handle housing 16 remain the same.

Handle housing 16 includes an elongated top wall 20 to which the lower ends of legs 14 of handle 12 are affixed with top wall 20 of handle housing 16 underlying and being parallel to hand grip 18 of handle 12. A pair of angled side walls 22 project downwardly from opposite lateral side edges of top wall 20 with side walls 22 diverging outwardly away from one another as side walls 22 project downwardly. If angled side walls 22 of handle housing 16 had been extended upwardly above top wall 20 of handle housing 16, side walls 22 would have intersected at the vertex of a triangular shape. However, top wall 20 interrupts or cuts off side walls 22 before they can intersect such that handle housing 16 has a truncated triangular cross-sectional shape when the cross-section is taken in a plane perpendicular to the axis of elongation of hand grip 18.

Figure 4:
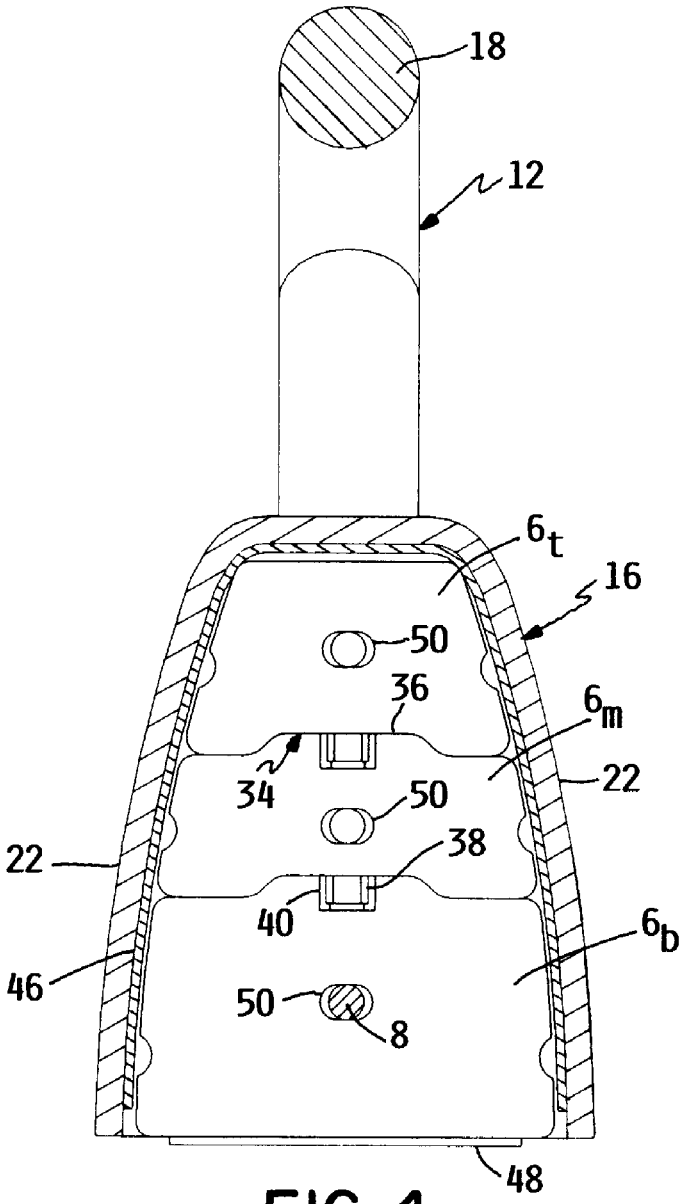
FIG. 4 is a cross-sectional view of the dumbbell of FIG. 1.

Nonetheless, even though the cross-sectional shape of handle housing 16 is a truncated triangular shape, the cross-sectional shape will be defined herein as a "generally triangular cross-sectional shape". This definition is intended to cover both a fully triangular cross-sectional shape where side walls 22 actually intersect at an actual vertex as well as a truncated triangular cross-sectional shape where side walls 22 intersect only at an imaginary or virtual vertex rather than an actual vertex due to the fact that side walls 22 are cut off or terminated below the virtual vertex by top wall 20. This definition is also intended to cover side walls 22 which are slightly arcuate or rounded as they extend downwardly as best depicted in FIGS. 1 and 4 as well as side walls that are purely flat or planar.

In addition to top wall 20 and side walls 22, handle housing 16 includes substantially vertical end walls 24, 26 that project downwardly from the ends of top wall 20 of handle housing 16. End walls 24, 26 have a height that is substantially the same as the height of side walls 22 and have a triangular shape that substantially matches the "generally triangular cross-sectional shape" of handle housing 16 to substantially fill in or close off the ends of the housing. Thus, the exterior enclosure formed by handle housing 16 is bounded or defined by horizontal top wall 10, angled side walls 22, and the vertical end walls 24, 26 of handle housing 16, with the bottom of handle housing 16 being open. When handle housing 16 is placed on a horizontal support surface, such as the top of a table or stand, handle housing 16 will be self-supporting on the support surface with the lower edges of angled side walls 22 and vertical end walls 24, 26 resting on the support surface and the open bottom of handle housing 16 being immediately adjacent or contiguous to the support surface. Effectively, handle housing 16 has a large, open, generally triangular, interior cavity 32 formed by the space or volume beneath top wall 20 and between side walls 22 and end walls 24, 26.

Figure 3:
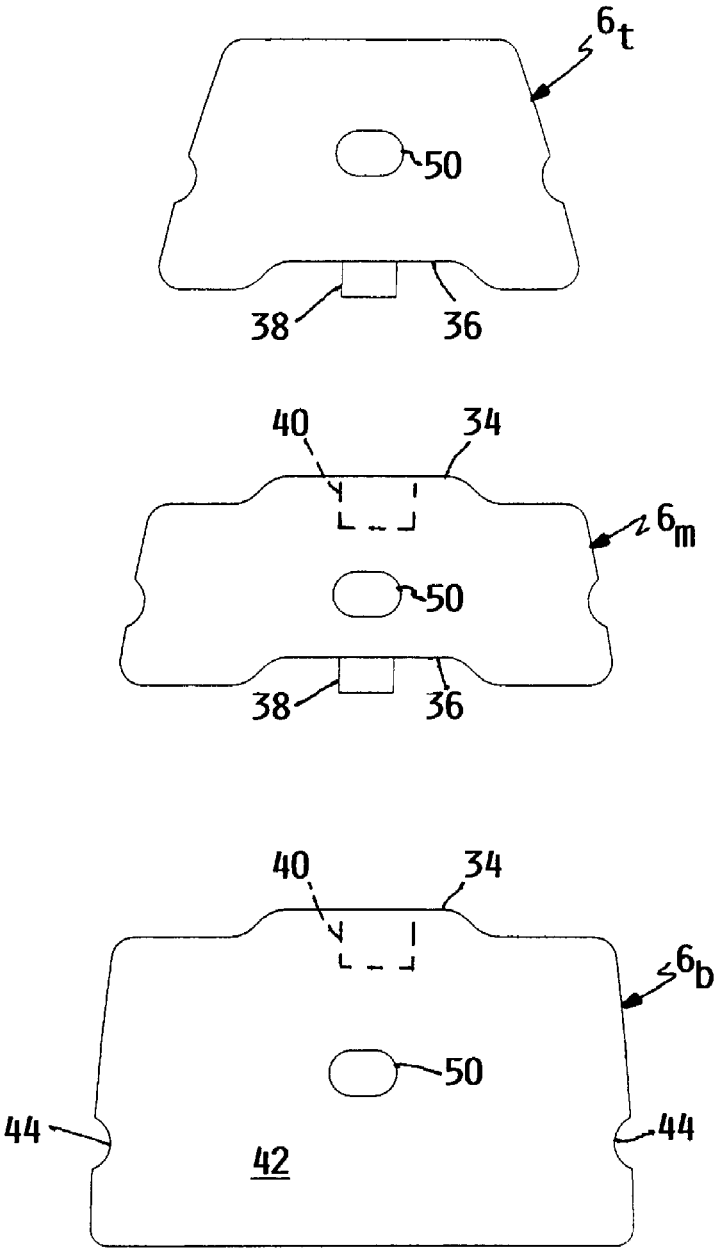
FIG. 3 is an end elevational view of a portion of the dumbbell of FIG. 1, particularly illustrating the add-on weights in an exploded form.

End walls 24, 26 of handle housing 16 carry a portion of the weight selection mechanism, namely end walls 24, 26 each include an array of vertically spaced holes 28 that begin below top wall 20 and that extend downwardly. Three such holes 28 comprising a top hole $\mathbf{28}_t$, a middle hole $\mathbf{28}_m$, and a bottom hole $\mathbf{28}_b$ are shown in FIGS. 1-3. The arrays of holes 28 provided in end walls 24, 26 are vertically aligned with one another such that top holes $\mathbf{28}_t$ in each of end walls 24, 26 are at the same vertical elevation, middle holes $\mathbf{28}_m$ in each of end walls 24, 26 are at the same but lower vertical elevation, and bottom holes $\mathbf{28}_b$ in each of end walls 24, 26 are at the same but still lower vertical elevation. While it is preferred that end walls 24, 26 be full size walls that extend downwardly over substantially the entire height and laterally over substantially the entire width of handle housing 16, end walls 24, 26 could alternatively be in the form of fairly narrow flanges or tabs that extend downwardly and laterally for a distance just long enough to provide a surface in which the arrays of holes 28 could be provided. However, in this flange or tab form of end walls 24, 26, the flanges or tabs would have to be thick enough to provide sufficient strength for their intended purpose of forming part of the weight selection mechanism.

Holes 28 are sized to accept another portion of the selection mechanism, namely a selector member which is in the shape of an elongated connecting pin 8 as shown in FIG. 3. Connecting pin 8 has an enlarged head 30 which is adapted to abut against one of end walls 24, 26 of handle housing 16 after connecting pin 8 has been passed through handle housing 16 with connecting pin 8 being received in one pair of holes 28. Head 30 can optionally include a magnet (not shown) whose magnetic strength is helps retain connecting pin 8 on one of end walls 24, 26, such walls being made of a metallic material, to prevent connecting pin 8 from being accidentally dislodged during use of dumbbell 2.

Turning now to add-on weights 6 that may additionally be used with handle assembly 4, each weight 6 has a generally triangular cross-sectional shape that mimics the shape of the vertical section of cavity 32 in which such weight 6 is received. In the embodiment of dumbbell 2 being described herein, there are three add-on weights 6 comprising a top weight $\mathbf{6}_t$, a middle weight $\mathbf{6}_m$, and a bottom weight $\mathbf{6}_b$. All three weights $\mathbf{6}_t$, $\mathbf{6}_m$, $\mathbf{6}_b$ are vertically stacked on top of one another in a nested manner that results from a tongue and groove interconnection between abutting surfaces of adjacent weights 6.

For example, middle weight $\mathbf{6}_m$ has an upwardly projecting tongue 34 on the top of middle weight $\mathbf{6}_m$ extending along the entire length of middle weight $6_m$. Similarly, top weight $6_t$ has a downwardly facing groove 36 on the bottom thereof extending along the entire length thereof. Groove 36 on top weight 6t receives tongue 34 on the top of middle weight $6_m$ such that tongue 34 snugly fits into and extends along length of groove 36 on top weight $6_t$. The same tongue and groove interconnection is present between bottom weight $6_b$ and middle weight $6_m$. When so nested together and received in cavity 32, weights 6 do not extend below the lower edges of side walls 22 of handle housing 16 such that that handle housing 16 is still self-supporting on a horizontal support surface even when all three weights 6 are nested within handle housing 16. See FIG. 4. When so nested, weights 6 are hidden within handle housing 16.

Even though weights 6 are securely nested to one another by tongue 34 and groove interconnections such that they are not easily dislodged by a lateral force perpendicular to their lengths, it would be possible for weights 6 to slide longitudinally along their lengths and possibly be disconnected from each other when the stack of all or some of weights 6 is not nested inside of handle housing 16. This might happen when handle assembly 16 is being used for exercise with none or only one of weights 6 carried inside cavity 32. To prevent any longitudinal sliding of nested weights 6, adjacent weights 6 further have a pin and hole interconnection. For example, top weight $6_t$ has a downwardly extending pin 38 on the bottom thereof which projects vertically downwardly out of groove 36 far enough to enter an upwardly facing hole 40 in tongue 34 of middle weight $6_m$. This prevents any longitudinal sliding between top weight $6_t$ and middle weight $6_m$. The same pin and hole interconnection is used between middle weight $6_m$ and bottom weight $6_b$. The use of both the tongue and groove interconnection and the pin and hole interconnection between adjacent weights 6 ensures that a full or partial stack of the weights that is not covered by handle housing 16 will resist inadvertent dislodgement of weights 6 and will aid the user in dropping handle housing 16 down onto or lifting handle housing 16 up off of a weight stack without the user dislodging weights 6.

As best shown in FIG. 2, weights 6 have substantially the same length 1 as one another which length is substantially equal to, but slightly less, than the distance between the inside surfaces of end walls 24, 26 of handle housing 16. Weights 6 have different widths w and heights h from one another. The widths w of weights 6 are driven by the progressively increasing distances between side walls 22 of handle housing 16. For any particular weight 6, width w of that weight 6 is chosen to be substantially equal to, but slightly less, than the distances between side walls 22 of handle housing 16 in that vertical section of cavity 32 that receives that particular weight. The number of weights 6 that are used could be varied and the heights h of weights 6 are chosen to achieve a desired increment of weight that each weight provides to dumbbell 2 when each weight is progressively added or coupled to handle assembly 4.

Weights 6 can be cost effectively manufactured by stamping out a plurality of steel plates 42, placing plates 42 in a horizontal stack on a pair of laterally spaced support rods (not shown) in a welding fixture (not shown) which rods are partially received in a small semi-circular recess 44 on opposite sides of plates 42 to support the horizontally stacked plates 42, and then robotically welding plates 42 together. Because tongue 34 and groove 36 run the full length of each weight 6, plates 42 used to manufacture a particular weight, e.g., $6_t$, are identical to one another, though different from plates 42 used for the other weights, e.g., $6_m$ or $6_b$. After plates 42 for a particular weight 6 have been welded together in this manner, pins 38 and holes 40 may be welded or drilled, respectively, into such weight 6. Alternatively, weights 6 could be manufactured in other suitable ways, such as by casting them from a molten material.

As should be apparent from looking at the cross-sectional view of FIG. 4, when all three nested weights $6_t$, $6_m$, $6_b$ are nested atop one another and nested inside cavity 32, the entire cavity 32 along both the length, width and height thereof is substantially filled up with or occupied by weights $6_t$, $6_m$, $6_b$ without any significant gaps or spaces within cavity 32, save for the very small gaps or spaces formed by recesses 44 used in the manufacturing process. This increases the maximum weight the dumbbell provides to substantially its theoretical limit for a given size of cavity 32 and a given material, e.g. steel or iron, used for weights $6_t$, $6_m$, $6_b$.

For noise reduction and to increase snugness of fit, a thin mat 46 made of a cushion providing or sound deadening material, e.g. an elastomeric material, is preferably adhered to the inside surfaces of top wall 10 and side walls 22 of handle housing 16. When so installed, mat 46 is sandwiched between top wall 10 and side walls 22 and the stacked and nested weights 6 when such weights 6 are received inside handle housing 16. Mat 46 cushions any movement that weights 6 might have against such walls to eliminate or substantially reduce any rattling noise during use of dumbbell 2. A similar mat 48 is adhered to the bottom surface of bottom weight $6_b$ to prevent the stacked array of weights 6 from marring the support surface on which they are received.

Another portion of the weight selection mechanism is provided in each weight 6, namely an elongated, hollow bore 50 that extends completely through the length of each weight 6 along approximately a longitudinal centerline of each weight 6. Each bore 50 is positioned in the center of each weight 6 in a location where it does not interfere with the tongue and groove and the hole and pin interconnections between adjacent weights 6. Each bore 50 is large enough to receive and accommodate pin 8 in a fairly close fit with bore 50 being somewhat horizontally elongated out of a purely circular shape to ease installation of pin 8 in any selected bore as best shown in FIG. 4.

If handle housing 16 functions as a weight to provide a first increment of the overall exercise mass of dumbbell 2, then each of weights 6 can be designed to provide increments of the same or different amounts. It should be apparent how weights 6 are coupled to handle assembly 4. For example, this can be done by inserting pin 8 through a selected hole 28, $28_m$, or $28_b$ in end wall 24 of handle housing 16 and then passing pin 8 through bore 50 on weight 6 that is aligned with such hole $28_t$, $28_m$, or $28_b$ until pin 8 emerges through the same hole $28_t$, $28_m$, or $28_b$ on opposite end wall 26 of handle housing 16. Note that the direction of pin 8 could be reversed if so desired, passing first through end wall 26 of handle housing 16 and exiting through end wall 24 of handle housing 16.

Pin 8 can be inserted through top hole $28_t$ to selectively couple only top weight $6_t$ to handle assembly 4. In this event, the total exercise mass provided by dumbbell 2 when the user grips hand grip 18 and lifts handle assembly 4 upwardly is the weight provided by handle assembly 4 itself and the additional provided by top weight $6_t$. When the user so lifts handle assembly 4, handle assembly 4 and top weight $6_t$ will rise together, leaving the unselected middle and bottom weights $6_m$, $6_b$ in a nested stack on the horizontal support surface.

To increase the exercise mass of dumbbell 2 still further, the user then selectively moves pin 8 to one of the lower holes 28 in end walls 24, 26 to pass pin 8 through bore 50 of either middle weight $\mathbf{6}_m$ or bottom weight $\mathbf{6}_b$. Such an action will positively couple the selected weight to handle assembly 4 as well as any of weights 6 above the selected weight since lifting the selected weight by lifting handle assembly 4 inherently carries with it any of weights 6 above the selected weight. The maximum exercise mass is provided when pin 18 couples bottom weight $\mathbf{6}_b$ to handle assembly 4 as shown by the position of pin 18 in FIGS. 1 and 4. The weight selection mechanism disclosed herein is easy to adjust and provides the user with the ability to quickly change the exercise mass of dumbbell 2 to one of a plurality of different possible values.

Side walls 22 of handle housing 16, and particularly the angles of inclination thereof in relation to the placement of hand grip 18, are designed to provide a surface on which the user may comfortably rest his or her forearm when doing certain exercises. For example, when doing an arm curl using dumbbell 2, the user will grip hand grip 18 from the underside of hand grip 18 with the user's hand being located in the gap or space between top wall 20 of handle housing 16 and hand grip 18 and with the user's forearm extending out over one side wall 22 of handle housing 16. As the user performs an arm curl, the exercise mass of dumbbell 2 will at some point cause handle housing 16 to swing into engagement with the user's forearm and rest against the user's forearm as the user completes the arm curl. However, this is comfortable to do since the angle of side wall 22 is oriented to provide a comfortable forearm rest in this situation.

Various modifications of this invention will be apparent to those skilled in the art. Accordingly, the scope of this invention is to be limited only the appended claims.

The invention claimed is:

1. A selectorized dumbbell, which comprises:

(a) a handle assembly that comprises a handle housing having an upwardly extending loop style handle in the manner of a kettlebell handle, the handle housing having an open bottom through which an interior cavity of the handle housing may be accessed;

(b) a plurality of weights vertically stacked on top of one another and when so stacked are received within the cavity of the handle housing, wherein the plurality of weights when so stacked form a plurality of different weight pairs with each weight pair comprising one weight and another weight that is immediately below the one weight and is in direct abutting contact with the one weight at a junction therebetween, wherein the plurality of weight pairs are nested together by tongue and groove interconnections at the junctions therebetween to resist dislodgement of the weights in the weight pairs in a direction that is perpendicular to the tongue and groove interconnections, wherein the tongue and groove interconnections are linear and extend horizontally completely along one dimension of the weights; and (c) a selectively repositionable connecting member that can be placed into different positions to selectively couple a desired number of the weights to the handle housing, the connecting member comprising an elongated body that extends along an axis of elongation.

2. The dumbbell of claim 1, wherein the plurality of weight pairs additionally have pin and hole interconnections at the junctions therebetween to resist dislodgement of the weights in the weight pairs in a second direction that is parallel to the tongue and groove interconnections.

3. The dumbbell of claim 2, wherein the pin and hole interconnections extend vertically.

4. The dumbbell of claim 3, wherein each weight has a horizontal bore extending completely through the weight along the longest dimension of the weight, wherein the body of the connecting member is slidably received within the bore of any selected weight to couple to the handle housing the selected weight and all weights that are above the selected weight, and wherein the tongue and groove and pin and hole interconnections between each weight pair in the plurality of weight pairs are vertically spaced relative to the bores in each weight pair in the plurality of weight pairs so as not to interfere with passage of the connecting member through any of the bores in each weight pair in the plurality of weight pairs.

5. The dumbbell of claim 1, wherein the cavity has a predetermined volume, and wherein the plurality of vertically stacked weights when received in the handle housing substantially entirely fill the volume of the cavity of the handle housing.

6. A selectorized dumbbell, which comprises:

(a) a handle assembly that comprises a handle housing having an upwardly extending loop style handle in the manner of a kettlebell handle, the handle housing further having an elongated top wall, a pair of angled side walls that project downwardly from opposite lateral side edges of the top wall with the side walls diverging outwardly away from one another as the side walls project downwardly to form a generally triangular cross-sectional shape, vertical end walls that project downwardly from opposite ends of the top wall with the end walls having a height that is substantially the same as the height of the side walls and having a generally triangular shape that substantially matches the generally triangular cross-sectional shape formed by the top wall and the side walls such that the top wall, side walls, and end walls form an open, generally triangular, interior cavity therebetween, wherein the handle housing further has an open bottom underlying the cavity to provide access to the cavity;

(b) a plurality of weights vertically stacked on top of one another and when so stacked are received within the cavity of the handle housing, wherein the weights when stacked on top of another and when received within the cavity substantially fill up the cavity in its entirety along a length, a width and a height of the cavity; and (c) a selectively repositionable connecting member that can be placed into different positions to selectively couple a desired number of the weights to the handle housing, the connecting member comprising an elongated body that extends along an axis of elongation.

7. The dumbbell of claim 6, further including a thin mat made of a cushion or sound deadening material on inside surfaces of at least the side walls of the handle housing such that the mat is sandwiched between at least the side walls of the handle housing and adjacent sides of the weights when the weights are received inside the handle housing.

8. The dumbbell of claim 6, further including a thin mat made of a cushion or sound deadening material on a bottom of a lowermost weight in the plurality of vertically stacked weights.

9. A selectorized dumbbell, which comprises:

(a) a handle assembly that comprises a handle housing having an upwardly extending loop style handle in the manner of a kettlebell handle, the handle housing further having an elongated top wall, a pair of angled side walls that project downwardly from opposite lateral side edges of the top wall with the side walls diverging outwardly away from one another as the side walls project downwardly to form a generally triangular cross-sectional shape, vertical end walls that project downwardly from opposite ends of the top wall with the end walls having a height that is substantially the same as the height of the side walls and having a generally triangular shape that substantially matches the generally triangular cross-sectional shape formed by the top wall and the side walls such that the top wall, side walls, and end walls form an open, generally triangular, interior cavity therebetween, wherein the handle housing further has an open bottom underlying the cavity to provide access to the cavity;

(b) a plurality of weights vertically stacked on top of one another and when so stacked are received within the cavity of the handle housing, wherein the weights are nested together to prevent sliding relative to one another by both tongue and groove interconnections and pin and hole interconnections between vertically adjacent weights; and (c) a selectively repositionable connecting member that can be placed into different positions to selectively couple a desired number of the weights to the handle housing, the connecting member comprising an elongated body that extends along an axis of elongation.

* * * * *